US006267255B1

(12) United States Patent
Brush

(10) Patent No.: US 6,267,255 B1
(45) **Date of Patent: *Jul. 31, 2001**

(54) MERCHANDISER WITH SHROUD AND HEADER FORMING PANELS

(76) Inventor: John Brush, P.O. Box 1106, Waterdown, Ontario (CA), L0R 2H0

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,537

(22) Filed: Jul. 24, 1998

(51) Int. Cl.[7] ..... A47F 1/00; B65D 19/00

(52) U.S. Cl. ..... 211/59.4; 211/72; 211/132.1; 206/386; 206/44 R; 206/586

(58) Field of Search ..... 211/59.4, 72, 132.1, 211/594, 188; 248/174; 206/386, 597, 600; 229/110, 164

(56) References Cited

U.S. PATENT DOCUMENTS

| | | | | |
|---|---|---|---|---|
| 2,249,881 | * | 7/1941 | Bouchelle | 206/757 X |
| 2,479,910 | * | 8/1949 | Davidson | 206/45.2 |
| 2,502,693 | * | 4/1950 | Alton | 211/133 |
| 2,620,117 | * | 12/1952 | Nemoede | 206/600 X |
| 2,633,285 | * | 3/1953 | Kells | 229/15 |
| 2,783,934 | * | 3/1957 | Connelly | 229/46 |
| 3,094,211 | * | 6/1963 | Bender | 206/386 |
| 3,687,408 | * | 8/1972 | Lake | 248/97 |
| 3,738,563 | * | 6/1973 | Eifrid | 229/41 |
| 3,961,706 | * | 6/1976 | Roccaforte et al. | 206/44 R |
| 4,042,127 | * | 8/1977 | Brossia | 214/10.5 R |
| 4,089,417 | * | 5/1978 | Osborne | 206/600 |
| 4,230,227 | * | 10/1980 | Kowall et al. | 206/600 |
| 4,313,556 | * | 2/1982 | Boyle et al. | 229/38 |
| 4,441,649 | * | 4/1984 | Nederveld | 206/600 X |
| 4,582,195 | * | 4/1986 | Carstens | 206/44 R |
| 4,705,162 | * | 11/1987 | Kupersmit | 206/597 X |
| 4,762,226 | * | 8/1988 | Gatton | 206/597 X |
| 4,813,536 | * | 3/1989 | Willis | 206/44 R |
| 5,020,674 | * | 6/1991 | Thorud et al. | 206/600 |
| 5,035,323 | * | 7/1991 | Daniels et al. | 206/597 X |
| 5,105,946 | * | 4/1992 | McDowell | 206/597 X |
| 5,139,145 | * | 8/1992 | Cook | 206/597 X |
| 5,160,025 | * | 11/1992 | Greenawald | 206/600 X |
| 5,251,753 | * | 10/1993 | Pigott et al. | 206/600 X |
| 5,328,024 | * | 7/1994 | Sutherland | 206/158 |
| 5,350,066 | * | 9/1994 | Mendoza et al. | 206/600 X |
| 5,372,255 | * | 12/1994 | Skorski et al. | 206/386 |
| 5,564,578 | * | 10/1996 | Smith | 211/132.1 X |

* cited by examiner

*Primary Examiner*—Jerry Redman
*Assistant Examiner*—Khoa Tran

(57) ABSTRACT

A merchandiser which has a product containing interior region is provided with a plurality of panels secured to the top surface of the merchandiser. The panels are foldable between a shroud forming position in which they cover the side faces of the merchandiser and a header forming position in which they project upwardly from the top surface of the merchandiser. The panels, when in the header forming position interlock with and hold one another in the header forming position. When the panels are in the header forming position, the product receiving interior region of the merchandiser is visible through the side faces of the merchandiser.

9 Claims, 7 Drawing Sheets

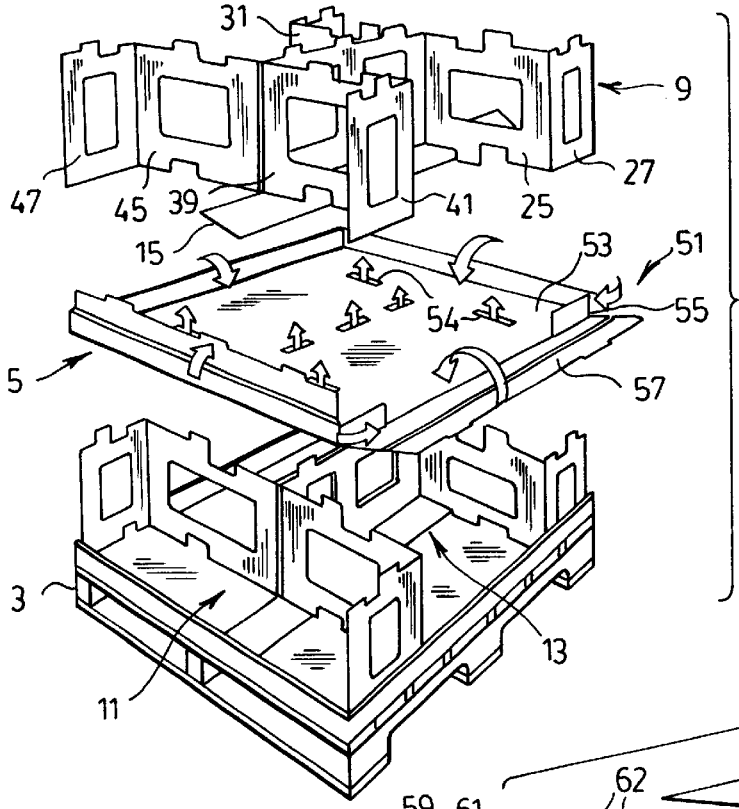
FIG. 4.
FIG. 5.
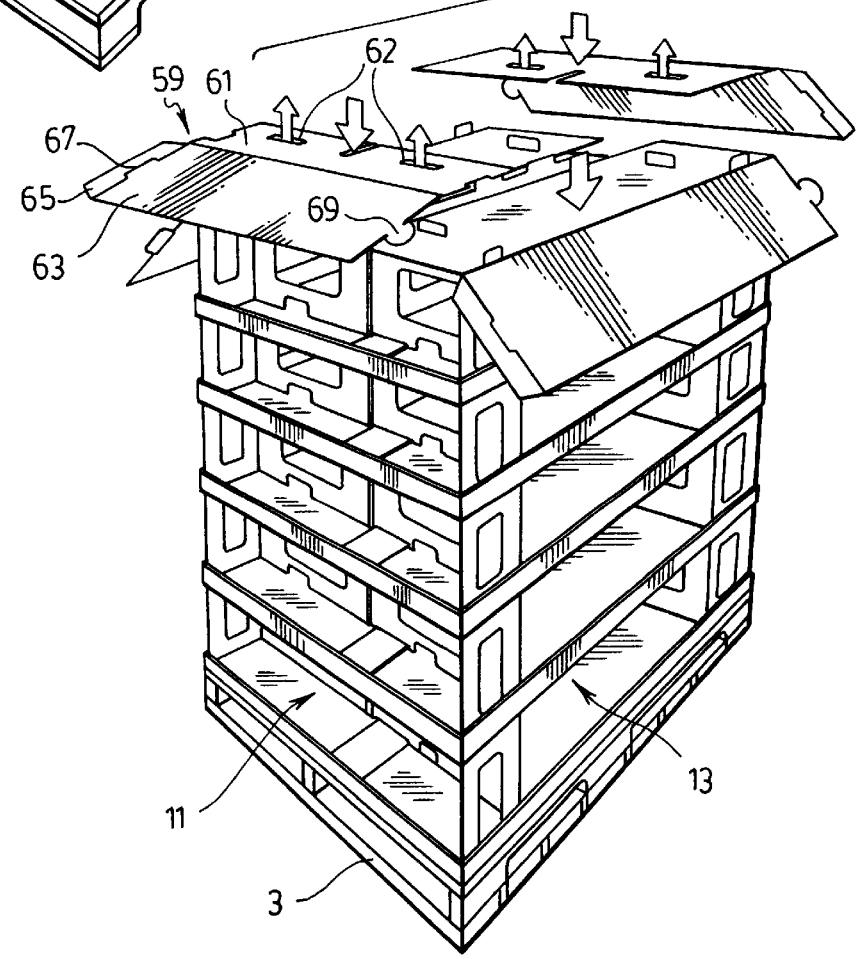

MERCHANDISER WITH SHROUD AND HEADER FORMING PANELS

FIELD OF THE INVENTION

The present invention relates to a merchandiser having panels which can be used as both a shroud and a header display.

BACKGROUND OF THE INVENTION

A typical merchandiser, which may be made from corrugated board, comprises a series of parts which interlock with one another. Often times, these parts are sold in an unassembled form to later be put together and loaded with product at a point of sale location. In some instances, the merchandiser may already be assembled, loaded with stock and then shipped to a point of sale location. Under these circumstances, the merchandiser is protected by a covering shroud which is removed and discarded at the final destination. A separate header display is then added to the merchandiser. In some cases, the header display is shipped separately from the merchandiser resulting in situations where the header display is not used because it is either lost or is simply not available when the display is set up and not later added.

SUMMARY OF THE INVENTION

The present invention provides a merchandiser having at least one panel which act as a protective shroud during shipping of the merchandiser and which later acts as a header at the point of sale for the merchandiser. This panel remains at all times attached directly to, rather than being separate from, the merchandiser thereby avoiding the problems encountered with previous merchandisers.

More particularly, the present invention provides a merchandiser having an attached panel which is foldable between a downwardly extending shroud forming position and between a downwardly extending shroud forming position and a header position extending upwardly away from the shroud forming position.

BRIEF DESCRIPTION OF THE DRAWINGS

The above as well as other advantages and features of the present invention will be described in greater detail according to the preferred embodiments of the present invention in which;

FIG. 4 is a perspective view showing the initial stages of assembly of the merchandiser of FIG. 1;

FIG. 5 is a further perspective view showing the final stages of assembly of the merchandiser of FIG. 1;

DETAILED DESCRIPTION ACCORDING TO THE PREFERRED EMBODIMENTS OF THE PRESENT INVENTION

Figure 1:
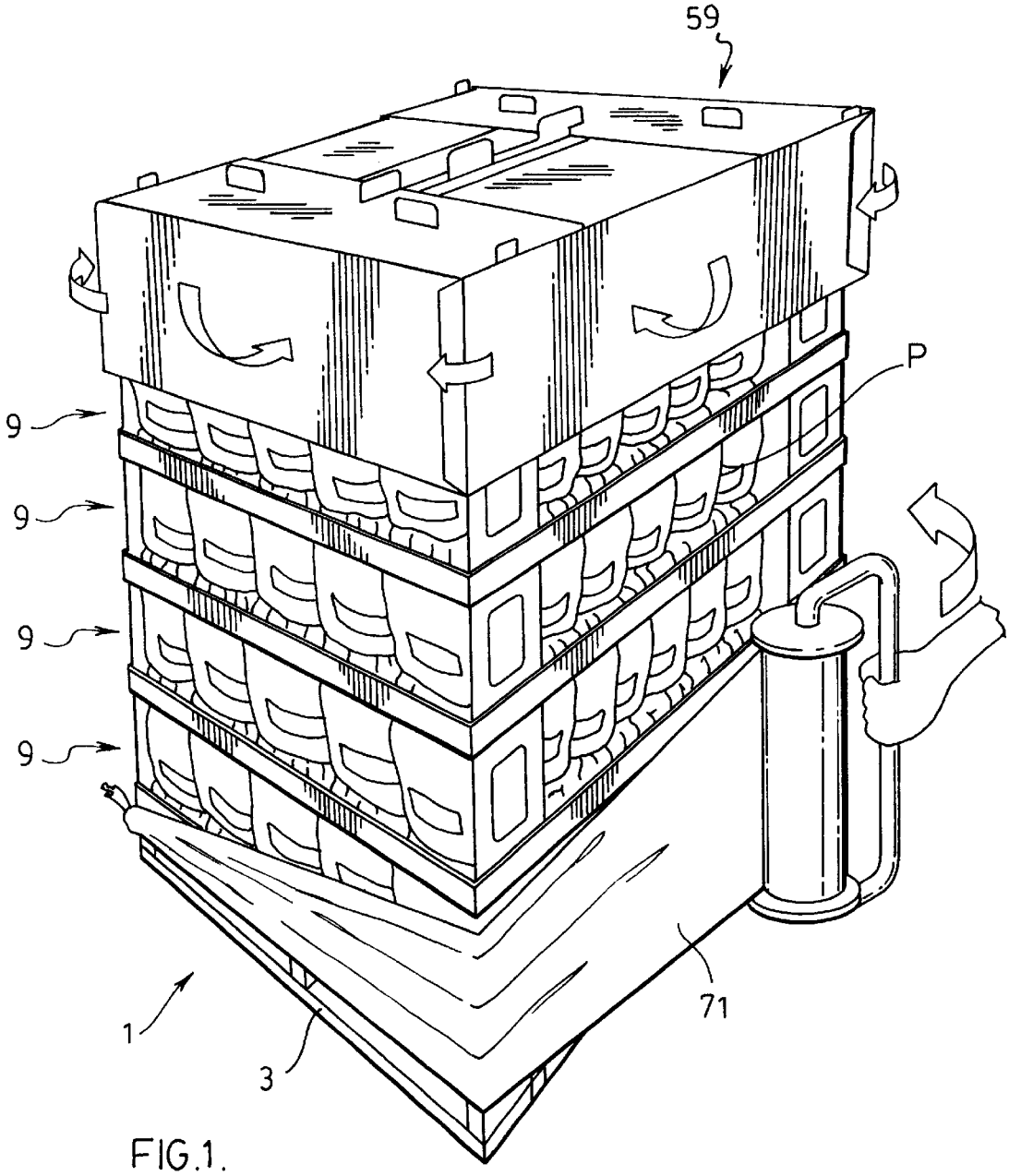
FIG. 1 is a perspective view of a merchandiser which is loaded with product and which is being prepared for shipping according to a preferred embodiment of the present invention.

FIG. 1 shows a merchandiser generally indicated at 1. This merchandiser, which sits atop a pallet 3 holds product P in a plurality of vertically separated layers, with as shown in the drawings at 5. The merchandiser in the FIG. 1 configuration is being prepared for shipping of product and is topped by a plurality of panels 59 arranged in a shroud forming position. In the embodiment which is shown, the shrouds formed by the panels 59, although extending partially down over the side faces of the merchandiser do not completely cover it. Therefore, the preparation of the merchandiser for shipping is completed by means of a shrink wrap 71. In this case, the product P is, for example, bags of potato chips or some other light product which can easily be confined by the shrink wrap in combination with the shrouds around the merchandiser. As will be appreciated, the merchandiser can be made shorter or the shrouds can be made longer to provide a more full coverage of the merchandiser by the shrouds.

FIGS. 4 and 5 of the drawings show the method of assembling the merchandiser. In particular, FIG. 4 shows the method of assembling the different vertical levels or layers of the merchandiser.

Each of levels within the merchandiser comprises a base a bottom wall generally indicated at 51 which supports a divider generally indicated at 9. This divider is located internally of and provides separate compartments within its own level or layer.

Figure 2:
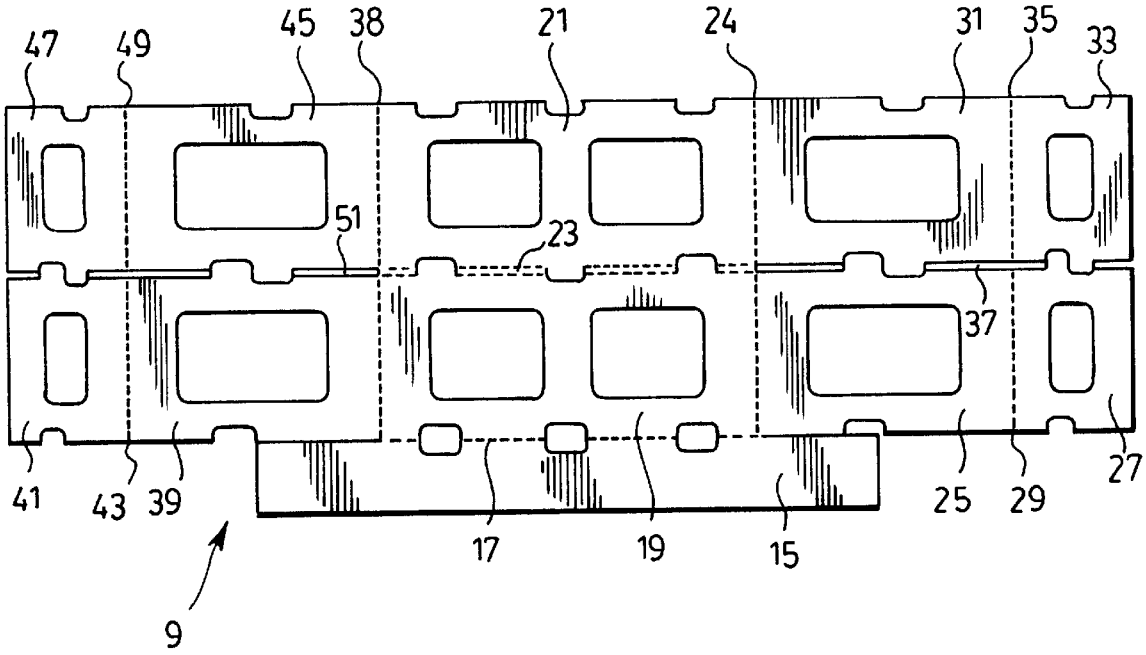
FIG. 2 is a plan view of a blank used to form an internal divider for any one of the vertical layers of the merchandiser shown in FIG. 1.
Figure 3:
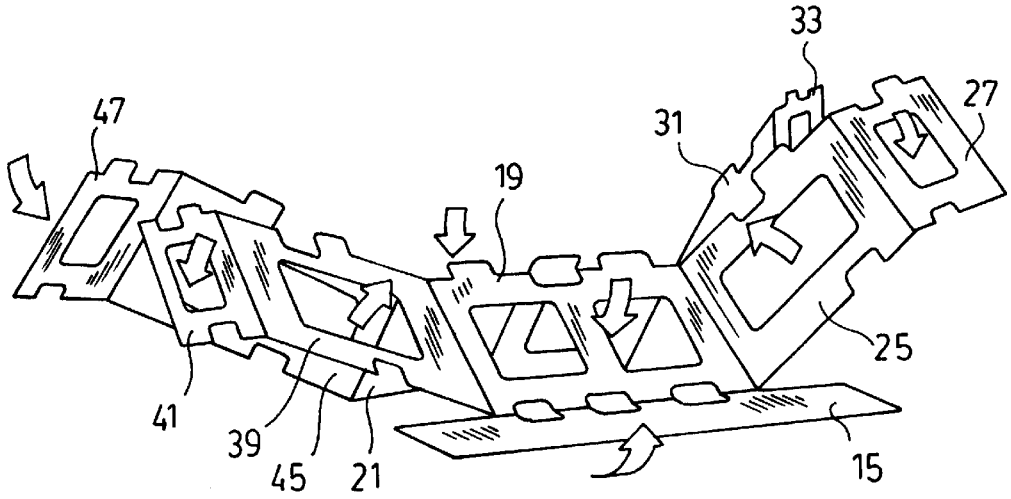
FIG. 3 shows in perspective the unfolding of the blank of FIG. 2 to form an internal divider.

FIGS. 2 and 3 show in greater detail, one of the dividers 9 which is representative of all of the dividers. The divider is preferably initially provided from a cardboard blank having a different series of openings and blank portions which unfold, as shown in FIG. 3, from the flat blank position of FIG. 2.

More particularly, divider 9, as it is initially formed, has a divider portion 15 which becomes the foot for the divider. This foot folds along fold line 17 relative to the remainder of the blank.

The remainder of the blank in turn comprises a plurality of blank parts 19, 21, 25, 31, 39 and 45. Blank parts 19 and 21 fold flat against one another along fold line 23 to form a center divider portion. Blank parts 25 and 31 completely separate from one another along score line 37. These two blank parts then fold outwardly relative to blank parts 19 and 21 respectively along fold line 24.

Blank parts 31 and 25 carry end portions 27 and 33 respectively. The blank end 27 is folded at 90° relative to blank part 25 along fold line 29. The blank end 33 folds at 90° to blank part 31 along fold line 35.

To the other end of the blank, blank parts 39 and 45 separate from one another along score line 51. These two blank parts then fold relative to blank parts 19 and 21 along fold line 38. Blank part 39 has an end portion 41 which folds at right angles to blank part 39 along fold line 43. Blank part 45 has an end portion 47 which folds at right angles to blank part 45 along fold line 49.

The overall opening and unfolding of the blank produces a divider shape as best shown in the upper part of FIG. 4. Here it will be seen that from the one blank the divider produces a plurality of different display areas such as display areas 11 and 13 shown in both FIGS. 4 and 5. In fact the one divider produces a separate display area for each side face of one level within the merchandiser.

The individual base or bottom wall 51 for each layer within the merchandiser again preferably has a cardboard construction. Each layer bottom wall 51 comprises a main support surface 53 having a plurality of recesses as best seen in FIG. 4. The bottom wall 51 further has short upright side walls formed by first and second wall portions 55 and 57. When the bottom wall is fully assembled, the second wall portion 57 folds downwardly against and to the inside of the first wall portion 55. The second wall portion 57 carries tabs which lock into tab receiving recesses within the main support surface 53 to hold the side walls in their folded positions.

As will again best be seen in FIG. 4 of the drawings, each of the dividers 9 when set up to fit into its own layer presents upwardly extending tabs which fit through the tab receiving recesses of the bottom wall of the layer above it. Furthermore, each of the divider feet 15 includes its own tab receiving recesses and the tabs from the divider of the layer below lock into these recesses. This holds the divider and base wall from one layer with the divider and base wall from an adjacent layer and therefore provides a vertical integration of the assembly. This integration of layers, in combination with the short vertical side walls of the base wall of each layer prevents horizontal shifting between the layers.

One of the primary features of the present invention is how the merchandiser is completed at its upper end. More particularly, the panels 59 are secured atop the merchandiser. There is a panel 59 for each side face of the merchandiser.

Each of the panels 59 as best seen in FIG. 5 of the drawings comprises first panel flap 61 and a second panel flap 63 with a fold line between the two panel flaps. Each of the second panel flaps 63 has, at one end, a foldable end portion 65 which, when folded against panel flap 63, exposes a tab receiving slot 67. A tab 69 extends from the other end of the panel flap 63.

As is again seen in FIG. 5 of the drawings, each of the panel flaps 61 is provided with a pair of slots 62. These slots, like the slots in each layer bottom wall are positioned to receive the upwardly protruding divider tabs. Accordingly, any one of the layers can be topped by either another layer or by the panels. As will be seen in FIG. 5 of the drawings, when the merchandiser is completed with the panels, the panel flaps 61 from all of the panels 59 cooperate with one another in forming a substantially complete top wall for the merchandiser.

As will be appreciated from the description immediately above, the merchandiser can be built with any number of different layers and then topped or completed with the panels regardless of the number of layers used.

Panels 59 in addition to providing a top wall for the merchandiser have two other functions. Firstly, as shown in FIG. 1 of the drawings, each panel flap 63 can be folded downwardly relative to its attached panel flap 61 which remains secured lying flat atop the merchandiser to form a shroud around the merchandiser. As earlier noted, this shroud may not extend the full height of the merchandiser but still provides benefits such as providing reinforcement to help maintain the rectangular configuration of the merchandiser.

Figure 7:
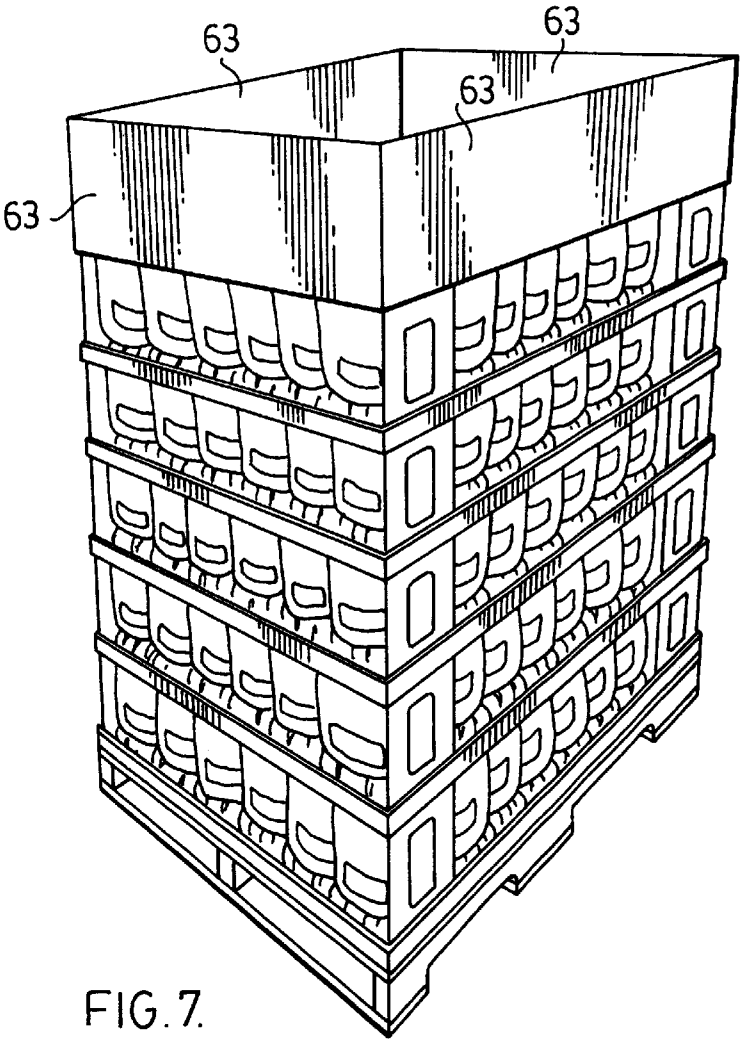
FIG. 7 shows the merchandiser of FIG. 1 in its final point of sale condition.
Figure 6:
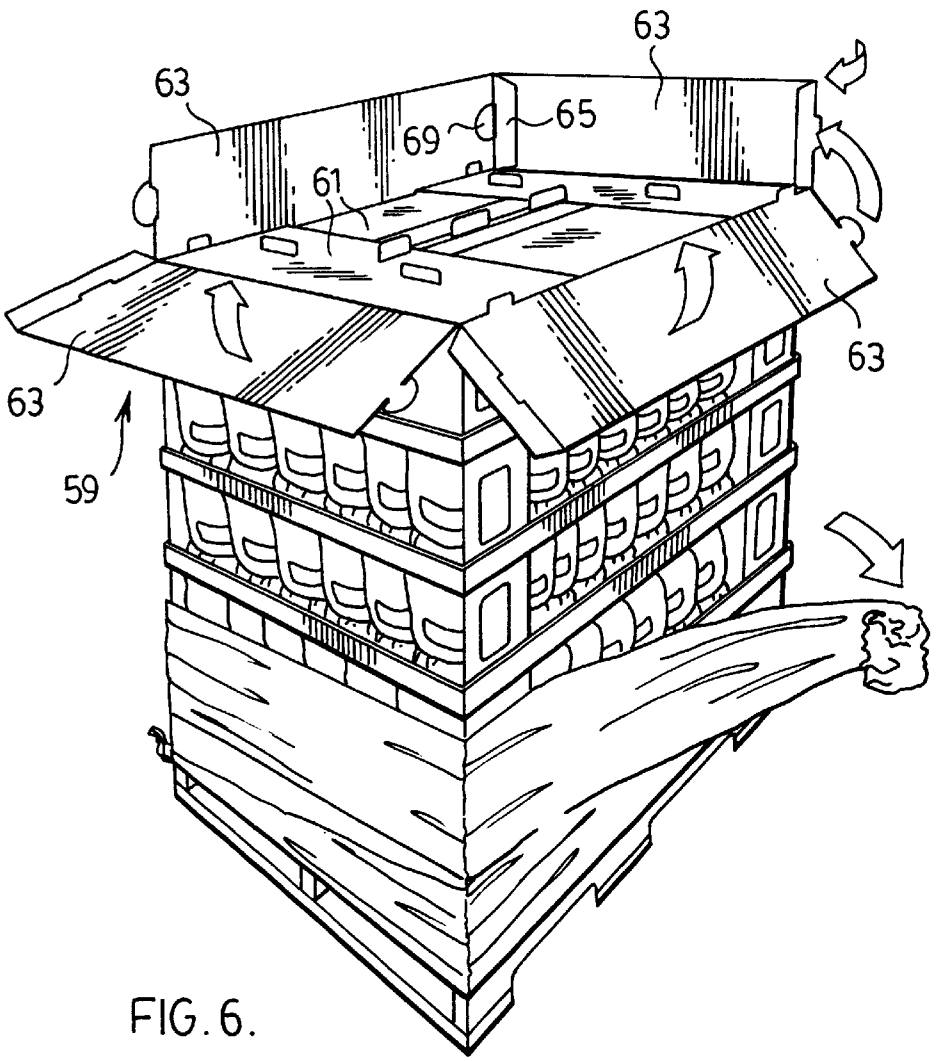
FIG. 6 is a perspective view showing the initial stages of preparing the merchandiser of FIG. 1 for use at a point of sale.

As shown in FIGS. 6 and 7 of the drawings, once the merchandiser has reached its point of sale loaded with product, the shrink wrap is removed and the panel flaps 63 are folded upwardly 180° from their shroud forming positions to a header display position. In the header display position, the panel flaps 63 extend vertically upwardly from the top and completely away from the side faces of the merchandiser. All of this is done without having to release the panel flaps 61 from their secured positions.

As seen in FIG. 6 of the drawings, the end portions 65 fold to the inside of the panel flaps 63 which enables the tab 69 from one panel flap to lock into the tab recess 67 of an adjacent panel flap. This interlocking of the tabs with the tab recesses around the merchandiser holds the panel flaps 63 in their upwardly extending display header positions.

It should be noted that in the shroud forming position, one side of each panel flap 63 is exposed and in the header display position the other side of the panel flap becomes exposed. Therefore any damage done to the panel flaps 63, when they are in their shroud forming position for shipping of the merchandiser is hidden when these same panel flaps are folded 180° upwardly to their header display positions. Conversely, the surfaces of the panel flaps 63, which are displayed in the header position, are protected against damage when the panel flaps 63 are in their downwardly extending shroud forming position.

Figure 8:
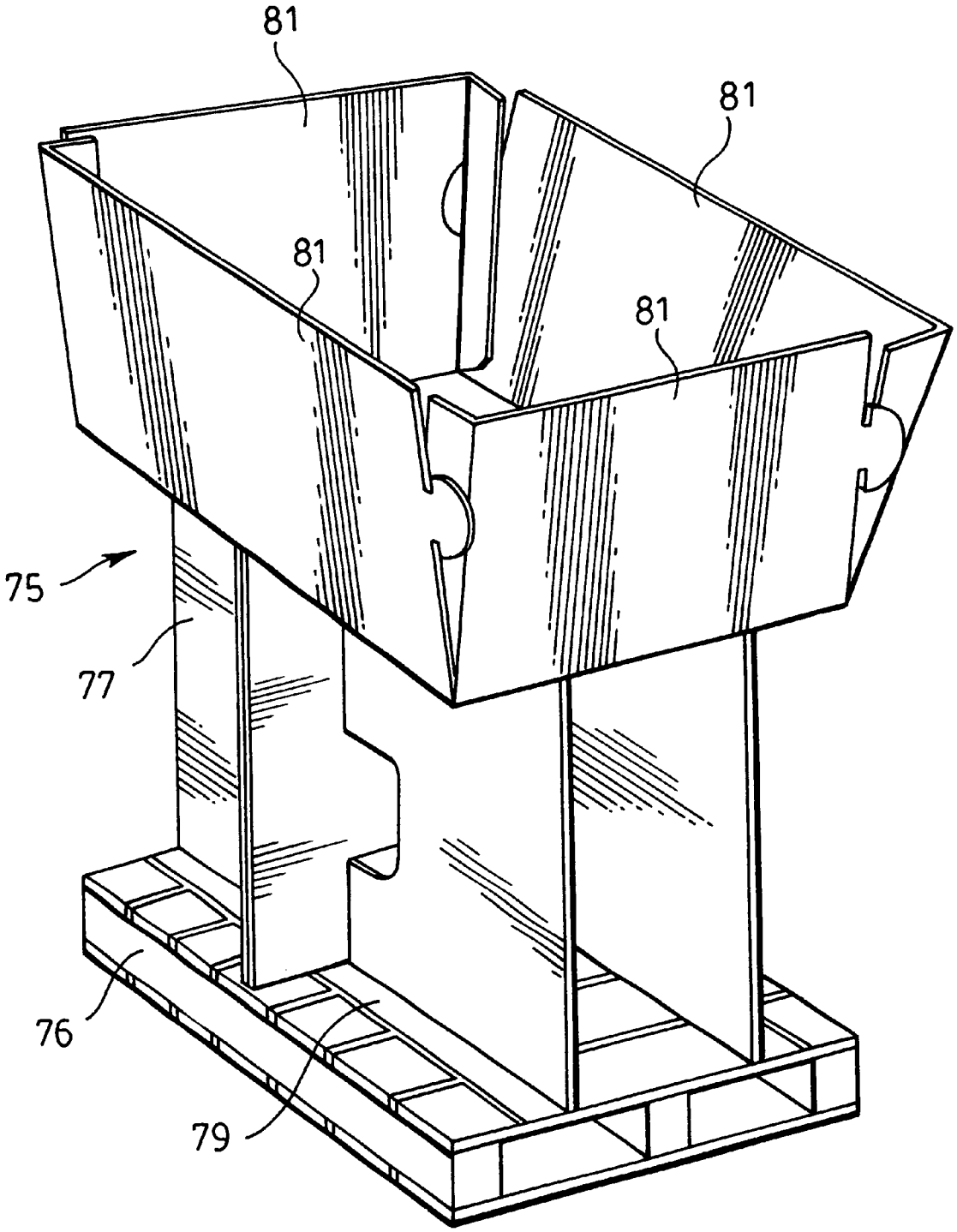
FIGS. 8 and 9 are perspective views of a merchandiser according to another embodiment of the invention.

The description above relates to a merchandiser which is built level by level. FIG. 8 of the drawings shows a further preferred embodiment merchandiser generally indicated at 75 built around a central column 77. This merchandiser sits atop a pallet 76 and includes upper end panels 81.

Figure 9:
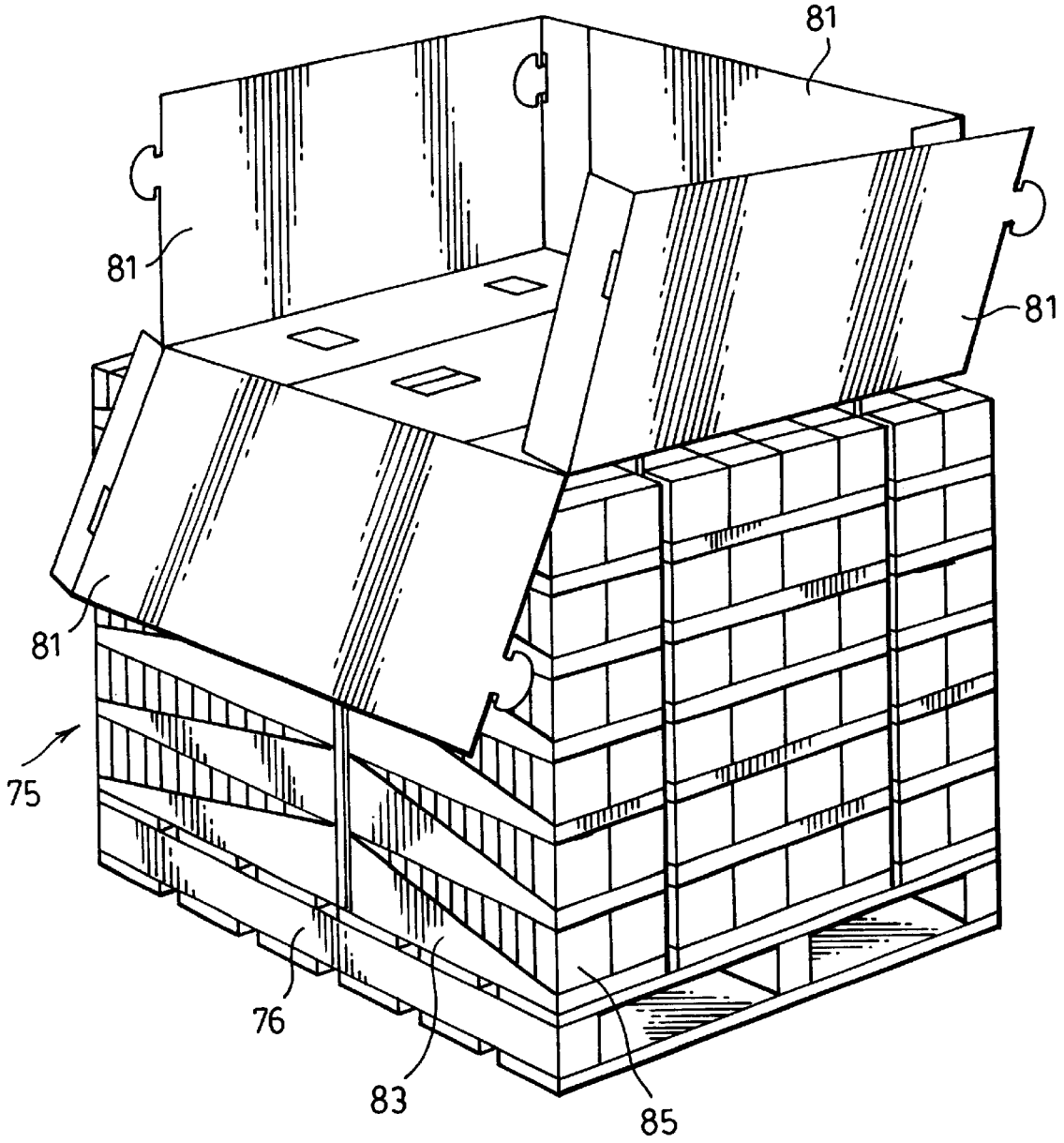

Column 77 is divided into a plurality of display areas to the different side faces of the merchandiser. FIG. 9 shows merchandiser 75 when loaded with product 85. This product is contained within boxes 83. The boxes are stacked atop one another as shown in FIG. 9 to form the individual layers within a merchandiser.

As also seen in FIG. 9, panels 81 are foldable between a downwardly extending shroud forming position as indicated by the panel to the left hand side of the drawing and an upwardly extending header forming position as indicated by the remaining panels. The panels have tab interlocks to hold them in the header forming position as well shown in FIG. 9 of the drawings.

In this particular arrangement, the product is removed at the upper layer first from the merchandiser. After the upper has been completely emptied, the boxes holding the product in the upper layer are removed to expose the second from the top layer. Panels 81 are not effected by the removal of the layers because they are supported by the fixed height central column 77 for the merchandiser.

Referring once again to FIG. 8, it will be seen that the central column 77 includes feet 79 on which the product is seated to hold the central column in its upright position as a frame work for the merchandiser.

Figure 10:
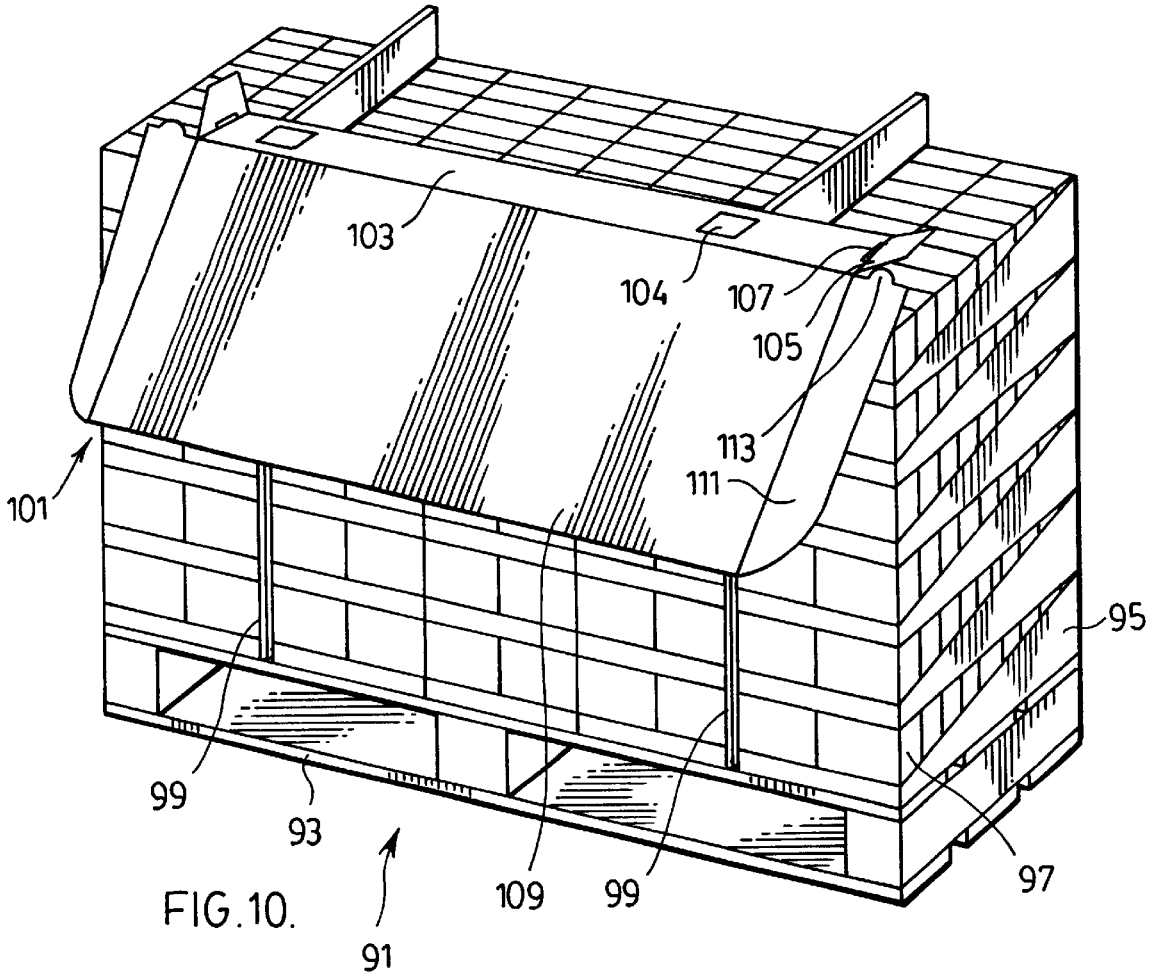
FIG. 10 is a perspective view of a merchandiser according to still a further preferred embodiment of the invention.

FIG. 10 of the drawings shows a further merchandiser generally indicated at 91. This merchandiser uses a pallet 93 which seats a supporting structure 99 for the merchandiser. Like the embodiment of FIGS. 8 and 9, product 97 contained within boxes 95 is built around the supporting structure 99. The supporting structure extends the full height of the merchandiser and a panel 101 is secured to the exposed upper end of the supporting structure 99.

More particularly, panel 101 comprises a first panel flap 103 secured at 104 to the upper end of supporting structure 99. A second panel flap 109 is foldably attached to the first panel flap 103.

As will be apparent from FIG. 10, this particular embodiment includes only a single panel rather than a plurality of panels as found in the earlier embodiments. In this single panel, the panel flap 109 folds down to form a shroud over the side face of the merchandiser as shown in FIG. 10. Panel flap 109 is also foldable through a 180° upwardly to a header forming position extending above the merchandiser. To this end, panel flap 103 is provided with foldable end portions 105 and tabs slots 107 while panel flap 109 is provided with foldable end portions 111 carrying tabs 113. Tabs 113 lock into tab recesses 107 to hold panel flap 109 in the header forming position.

Note that the boxes 95 provide a substantial amount of protection for the product 97 on the side faces of the merchandiser which are not protected by panel flap 109 in the shroud forming position.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A merchandiser having a plurality of side faces and a panel at each side face, the panels being secured atop said merchandiser, said panels being foldable between a shroud forming position extending downwardly over the side faces and a header display position extending upwardly from the shroud forming position, the panels when in the header display position interlocking with and holding each other in the header display position, said merchandiser having an interior product receiving region visible through said side faces when said panels are in the header dispaly position.

2. A merchandiser as claimed in claim 1, wherein each of said panel comprises first and second panel flaps with a fold line therebetween, the first panel flaps being secured in a flat lying position atop the merchandiser and the second panel flaps being foldable through 180° between the shroud forming and the header positions while the first panel flaps remain in the flat lying position.

3. A merchandiser as claimed in claim 2, wherein the first panel flaps form a top wall for said merchandiser.

4. A merchandiser as claimed in claim 2, wherein said second panel flaps include interlocks which secure with one another around the merchandiser to hold the second panel flaps in the header display position.

5. A merchandiser as claimed in claim 4, wherein said interlocks comprise a plurality of tabs and tab receiving recesses.

6. A merchandiser as claimed in claim 1, comprising a plurality of vertical layers, each layer comprising a base wall and an internal divider having upwardly extending tabs, each base wall having tab slots to receive the upwardly extending tabs of the divider immediately therebelow, the base walls and dividers of all of the layers having corresponding constructions and the panels further having tab slots which are interlockable with the tabs of any one of said dividers to secure the panels to the merchandiser such that each layer may be interlocked thereabove with either a further layer or the panels enabling said merchandiser to be built with any desired number of said layers.

7. A merchandiser as claimed in claim 6, having a rectangular shape with four of said side faces, each layer having a separate display area at each side face and all of the display areas in each layer being formed by the divider in that layer.

8. A merchandiser as claimed in claim 2, wherein said second panel flaps have first and second faces to opposite sides of said second panel flaps, the first faces being exposed and the second faces being covered when said second panel flaps are in the shroud forming position and the second faces being exposed and the first faces being hidden when said second panel flaps are in the header display position.

9. A merchandiser having an interior region with upper end upwardly projecting tabs, a plurality of side faces and a plurality of panels comprising first and second panels parts, said first panel parts secured by said upwardly projecting tabs to said merchandiser to provide a top wall for said merchandiser, each of said first panel parts forming a part of said top wall, said second panel parts being foldable relative to said first panel parts between a shroud forming position extending downwardly over the side faces and a header display position extending upwardly from the shroud forming position, said second panel parts when in the header display position interlocking with one another to hold all of said second panel parts in the header display position, said merchandiser having an interior product receiving region visible through said side faces when said second panel parts are in the header display position.

* * * * *